US007307469B2

(12) United States Patent
Yamada et al.

(10) Patent No.: US 7,307,469 B2
(45) Date of Patent: Dec. 11, 2007

(54) STEP-DOWN POWER SUPPLY

(75) Inventors: Hitoshi Yamada, Tokyo (JP); Mineo Noguchi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 86 days.

(21) Appl. No.: 11/176,285

(22) Filed: Jul. 8, 2005

(65) Prior Publication Data

US 2006/0017496 A1 Jan. 26, 2006

(30) Foreign Application Priority Data

Jul. 26, 2004 (JP) ..... 2004-217063

(51) Int. Cl.
*G05F 3/02* (2006.01)

(52) U.S. Cl. ..... 327/540; 327/541

(58) Field of Classification Search ..... None
See application file for complete search history.

(56) References Cited

U.S. PATENT DOCUMENTS 5,321,653 A * 6/1994 Suh et al. ..... 365/189.09
5,696,465 A * 12/1997 Ishizuka ..... 327/544
6,184,744 B1 * 2/2001 Morishita ..... 327/541
6,998,903 B2 * 2/2006 Jin ..... 327/541
2003/0184362 A1 * 10/2003 Kwon ..... 327/540
2004/0212422 A1 * 10/2004 Jung et al. ..... 327/541
2004/0217804 A1 * 11/2004 Moon et al. ..... 327/540

FOREIGN PATENT DOCUMENTS

JP 11-214617 8/1999

* cited by examiner

*Primary Examiner*—Tuan T Lam
(74) *Attorney, Agent, or Firm*—Nixon Peabody LLP; Donald R. Studebaker

(57) ABSTRACT

A step-down power supply receives an external power supply voltage and supplies power at a reduced voltage from an output node to a load. The power supply also receives a reference voltage and a control signal indicating the whether the load is active or not. The reduced power supply voltage is held equal to the reference voltage by adjustment of the voltage at an internal control node. To prevent fluctuations in the reduced power supply voltage at active-inactive transitions of the load, the power supply includes circuitry for pulling the voltage at the internal control node both up and down, circuitry for leaking current from the output node to ground, circuitry for temporarily raising and lowering the reference voltage, or a capacitor coupling the reference voltage signal line to the control signal line.

3 Claims, 14 Drawing Sheets

STEP-DOWN POWER SUPPLY

BACKGROUND OF THE INVENTION

1. Field of the Invention

The present invention relates to a step-down power supply that lowers the voltage of externally supplied power to provide a load with power at a voltage equal to a reference voltage.

2. Description of the Related Art

FIG. 13 shows a simple step-down power supply 400 that can be integrated into, for example, a semiconductor memory chip. The output of a differential amplifier or comparator 401 is coupled through a control node G0 to the gate of a p-channel metal-oxide-semiconductor (PMOS) transistor 402. Power supplied from an external source at a voltage VCC is fed through the PMOS transistor 402 to drive internal load circuits 405 such as the sense amplifiers that amplify voltages from memory cells. The differential amplifier 401 compares the internal power supply voltage VDD with a reference voltage (Vref) and adjusts the conductivity (current-driving capability) of the PMOS transistor 402 so as to hold VDD at the reference voltage level.

If the current drawn by the loads 405 increases, as it does when the sense amplifiers are activated, for example, the internal power supply voltage VDD falls, but the differential amplifier 401 detects the fall and increases the conductivity of the PMOS transistor 402, thereby restoring VDD to the reference level. This feedback control takes place, however, with a certain delay. If the current draw increases abruptly, as illustrated in FIG. 14, VDD falls too rapidly for the differential amplifier 401 to keep up, and an unavoidable voltage droop occurs. The size of the droop can be reduced by enlarging the differential amplifier 401 and PMOS transistor 402 to increase their current-driving capability, but the attendant increase in chip size and current consumption by the step-down power supply 400 is undesirable.

Japanese Patent Application Publication No. H11-214617 suggests the modification shown in FIG. 15, in which a pull-down circuit 403 is added to pull the control node G0 down to the ground level (VSS) when the sense amplifiers in a memory circuit are turned on. The pull-down circuit 403 receives a sense amplifier activation signal (SA_ON). When SA_ON goes high, an internal pull-down signal in the pull-down circuit 403 goes high for a predetermined interval, turning on a transistor (not shown) that connects node G0 to ground (VSS). The conductivity of the PMOS transistor 402 then increases rapidly and the VDD voltage droop is much reduced, as illustrated in FIG. 16.

FIG. 17 shows another conventional step-down power supply. This step-down power supply 1 receives power from an external source at a voltage VCC, such as 3.3 V, for example, lowers the external power supply voltage to generate an internal power supply voltage VDD equal to a reference voltage Vref, such as 2.5 V, for example, and provides the internal power supply voltage to a load circuit 2. The step-down power supply 1 comprises a reference voltage generator 10, a control circuit 30, and a stepped-down voltage output circuit 40. The reference voltage generator 10 generates the reference voltage Vref. The control circuit 30 switches a step-down control signal S30 between a high level and a low level according to the amount of current drawn by the load circuit 2. The stepped-down voltage output circuit 40 receives the reference voltage Vref and the step-down control signal S30 and outputs the internal power supply voltage VDD.

The stepped-down voltage output circuit 40 comprises PMOS transistors 41, 42, 47, n-channel metal-oxide-semiconductor (NMOS) transistors 43, 44, 45, and a constant-current source 46. PMOS transistor 41 has its source connected to the VCC power source, its drain connected to a node N42, and its gate connected to a node N41. PMOS transistor 42 has its source connected to the VCC power source and its drain and gate connected to node N41. NMOS transistor 43 has its source connected to a node N43, its drain connected to node N42, and its gate connected to a node N45. NMOS transistor 44 has its source connected to node N43, its drain connected to node N41, and its gate connected to a node N44. NMOS transistor 45 has its source connected to ground (VSS), its drain connected to node N43, and its gate connected to a node N46. PMOS transistor 47 has its source connected to the VCC power source, its drain connected to node N44, and its gate connected to node N42. The constant-current source 46 is connected between node N43 and ground. Node N45 receives the reference voltage Vref. Node N46 receives the step-down control signal S30. Node N44 outputs the internal power supply voltage VDD.

PMOS transistors 41 and 42 form a current mirror structure with identical source potentials and identical gate-source voltages. In the steady state, the source-drain currents I41 and I42 of PMOS transistors 41 and 42 are identical, and the potentials at nodes N41 and N42 are both equal to VCC−Vtp, where Vtp is the source-drain voltage of PMOS transistors 41 and 42. The source-drain currents I43 and I44 of NMOS transistors 43 and 44 are also identical (I41=I42=I43=I44), which implies that the gate potentials of NMOS transistors 43 and 44 are equal; the internal power supply voltage VDD is therefore equal to the reference voltage Vref. If the current IVDD drawn by the load circuit 2 varies, feedback in the stepped-down voltage output circuit 40 operates to maintain the equality of VDD and Vref by adjusting the potential at node N42, thereby adjusting the conductivity of PMOS transistor 47.

The response speed of this feedback control loop depends on the rate at which the gate capacitances of the transistors, especially PMOS transistor 47, can be charged and discharged. This depends on the magnitude of currents I41, I42, I43, and I44; that is, the response speed of the stepped-down voltage output circuit 40 depends on its current consumption. While the load circuit 2 is in the standby state and draws a small and relatively constant amount of current IVDD, rapid feedback control is not necessary, so the step-down control signal S30 is driven low, turning off NMOS transistor 45 and reducing the current consumption of the stepped-down voltage output circuit 40. When the load circuit 2 is active and draws a larger and more variable amount of current IVDD, the step-down control signal S30 is driven high, turning on NMOS transistor 45 to increase the current flow through the stepped-down voltage output circuit 40 and provide a faster feedback response.

The current IVDD drawn by the load circuit 2 is the source-drain current I47 of PMOS transistor 47 (I47=IVDD). When the load circuit 2 is in the standby state and NMOS transistor 45 is turned off, the steady-state potential at node N42 is VCC−Vtp1, where Vtp1 is comparatively small. The relatively slow response in this state is illustrated in FIG. 18: if the reference voltage Vref rises from its normal level V40 to a higher level V41 while the step-down control signal S30 is low, the internal power supply voltage VDD rises comparatively slowly from V40 to the new level V41. During this rise, the potential at node N42 temporarily drops.

When the load circuit 2 is in the active state, the step-down control signal S30 is high, NMOS transistor 45 is turned on, the sum (I43+I44) of currents I43 and I44 increases from I46 to I45+I46, and the sum (I41+I42) of currents I41 and I42 also increases from I46 to I45+I46. The potential at node N42 in this state is now VCC−Vtp2, where Vtp2 is comparatively large. If the reference voltage Vref rises from its normal level V40 to a higher level V41 in this state, the internal power supply voltage VDD rises comparatively quickly from V40 to the new level V41, as shown at the bottom of FIG. 18, but the potential at node N42 still drops temporarily, and the drop is greater than the corresponding drop in the standby-state when S30 is low.

FIG. 18 shows that the stepped-down voltage output circuit 40 responds faster to a change in the reference voltage Vref when the step-down control signal S30 is high than when S30 is low. Similarly, the response to a change in the current IVDD drawn by the load circuit 2 is faster when the S30 is high than when S30 is low.

The voltage changes in FIG. 18 can be explained as follows. In the state in which the step-down control signal S30 is low, for example, when the reference voltage Vref rises from V40 to a higher voltage V41, the gate-source voltage of NMOS transistor 43 becomes higher than the gate-source voltage of NMOS transistor 44, and the drain-source current I43 of NMOS transistor 43 becomes greater than the drain-source current I44 of NMOS transistor 44 (I43>I44). Accordingly, the voltage at node N42 falls below VCC−Vtp1. This increases the gate-source voltage and therefore the conductivity of PMOS transistor 47, thereby increasing the internal power supply voltage VDD.

A problem with the conventional step-down power supply in FIG. 15 is that if the response of the feedback control system including the differential amplifier is slow, after being pulled down, the control node G0 cannot return quickly to its normal potential level, and may remain at a comparatively low level even after the current drawn by the internal load circuits 405 has fallen back to the original level. As a result, the conductivity of PMOS transistor 402 is too high, and the internal power supply voltage VDD increases, as shown in FIG. 19. This problem is observed when the rapid rise in current draw that occurs when the internal load circuit is activated is immediately followed by a decline in the current draw.

The conventional step-down power supply in FIG. 17 is apt to malfunction when the level of the step-down control signal changes. The cause of the malfunction will be described with reference to FIG. 20, which shows voltage, current, and timing waveforms illustrating the operation of the stepped-down voltage output circuit 40.

The load circuit 2 draws current IVDD equal to I1 in the standby state and I2 in the active state. When the load circuit 2 enters the active state, IVDD abruptly increases from I1 to I2, causing the step-down control signal S30 to go high. The current flowing between node N43 and ground (VSS) abruptly increases from I46 to I46+I45 and the voltage at node N43 abruptly decreases from a value Vtn to a lower value Vtn−α, where a depends on the characteristics of the PMOS and NMOS transistors used. The voltage drop at node N43 is coupled through the gate-source capacitance of NMOS transistor 43 to node N45, causing the reference voltage Vref to decrease temporarily from V40 to a lower value V40−ΔV1. The voltage at node N42 likewise decreases temporarily to a value lower than both VCC−Vtp3 (the normal value in the standby state) and VCC−Vtp4 (the normal value in the active state). The internal power supply voltage VDD also drops temporarily, mimicking the change in the reference voltage Vref. After a certain delay, the reference voltage generator 10 restores the reference voltage Vref to V40 and the internal supply voltage VDD also returns to V40.

When the load circuit 2 returns to the standby state and its current draw IVDD decreases from I2 to I1, the step-down control signal S30 goes low, the current flowing between node N43 and ground to decreases from I46+I45 to I46, and the voltage at node N43 increases from Vtn−α to Vtn. The voltage rise at node N43 is coupled through the gate-source capacitance of NMOS transistor 43 to node N45, causing the reference voltage Vref to rise temporarily to V40+ΔV2. The internal power supply voltage VDD likewise rises to V40+ΔV2, while node N42 rises to a level higher than both VCC−Vtp3 and VCC−Vtp4. After a delay, the reference voltage generator 10 restores the reference voltage Vref to V40, node N42 returns to VCC−Vtp3, and the internal power supply voltage VDD returns to V40.

The temporary rise and fall of the internal power supply voltage VDD to levels above and below V40, caused by the temporary excursions of the potential at node N42 to levels above VCC−Vtp3 and below VCC−Vtp4, temporarily degrades the internal response speed, timing margin, and input voltage margin of the load circuit 2, and can cause the load circuit to malfunction.

SUMMARY OF THE INVENTION

A first object of the present invention is to provide a step-down power supply that includes a pull-down circuit to handle sharp increases in the current drawn by internal load circuits, but does not allow the internal power supply voltage VDD to increase after the pull-down circuit has operated.

A second object of the invention is to enable a step-down power supply to operate with reduced current consumption when its load circuit is in the standby state, without having the internal power supply voltage temporarily increase or decrease at transitions between the active and standby states.

The invention provides several step-down power supplies meeting these objects. All of these step-down power supplies lower an external power supply voltage with respect to a ground voltage to generate an internal power supply voltage equal to a reference voltage, and supply the internal power supply voltage to an internal load circuit.

One step-down power supply meeting the first object receives a load activation signal indicating activation of the internal load circuit. A differential amplifier compares the internal power supply voltage with the reference voltage and adjusts the voltage at a control node if the internal power supply voltage differs from the reference voltage. A driver having a control terminal connected to the control node receives the external power supply voltage and outputs the internal power supply voltage responsive to the voltage at the control node. A pull-down circuit supplies the ground voltage to the control node for a first predetermined time in response to the load activation signal. A pull-up circuit supplies the external power supply voltage to the control node for a second predetermined time following the first predetermined time.

By pulling the voltage at the control node first down, then up, this step-down power supply prevents the internal power supply voltage from rising or falling significantly when the internal load circuit is activated.

Another step-down power supply meeting the first object receives a chip activation signal indicating activation of a semiconductor chip including the internal load circuit. The power supply has a differential amplifier and a driver, which operate as described above. A leak circuit supplies the ground voltage to the control node for a predetermined time in response to the chip activation signal, thereby causing current to leak from the control node to ground.

The leaking of current to ground for the predetermined time causes the differential amplifier to bring down the voltage at the control node before the internal load circuit is activated. When the internal load circuit is activated and starts to draw significant current, the control node voltage only has to fall a little farther to enable the driver to start supplying the necessary current at the correct internal power supply voltage. The internal power supply voltage therefore quickly reaches the correct level and is then held there by feedback through the differential amplifier, without falling significantly below or rising significantly above the correct level.

A step-down power supply meeting the second object of the invention includes a reference voltage generator for generating a reference voltage, a stepped-down voltage output circuit that generates the internal power supply voltage, holds the internal power supply voltage at the reference voltage level, and provides the internal power supply voltage to the internal load circuit, and a control circuit that generates a step-down control signal. The step-down control signal is switched between a first voltage level and a second voltage level according to the amount of current drawn by the internal load circuit.

The stepped-down voltage output circuit includes first, second, and third elements, each having an input terminal, an output terminal, and a control terminal. The first element conducts current from its input terminal to its output terminal with conductivity controlled by the reference voltage, which is received at its control terminal. The second element conducts current from its input terminal, which is connected to the output terminal of the first element, to ground responsive to the step-down control signal, which it receives at its control terminal. The third element receives the external power supply voltage at its input terminal and supplies current to the internal load circuit from its output terminal, operating with a conductivity controlled by the voltage at its control terminal, which is connected to the input terminal of the first element. The stepped-down voltage output circuit also has a capacitor connected between the control terminals of -the first and second elements.

When the step-down control signal rises or falls, the voltage at the output terminal of the first element falls or rises in the opposite direction. This voltage change is capacitively coupled through the first element, from its output terminal to its control terminal, and could perturb the reference voltage, but the effect is canceled by the coupling of the opposite change in the step-down control signal through the capacitor connected to the control terminals of the first and second elements. The reference voltage therefore remains substantially constant. Consequently, the internal power supply voltage remains substantially constant.

Another step-down power supply meeting the second object of the invention includes a reference voltage generator, a control circuit, and a stepped-down voltage output circuit with first, second, and third elements that conduct current as described above. The stepped-down voltage output circuit also has a circuit that applies the ground voltage to the control terminal of the third element for a first predetermined time when the step-down control signal is switched from the first level to the second level, and applies the external power supply voltage to the control terminal of the third element for a second predetermined time when the step-down control signal is switched from the second voltage level to the first voltage level.

Although the changes in level of the step-down control signal temporarily perturb the reference voltage by the capacitive coupling through the first element noted above, during these temporary fluctuations of the reference voltage, the control terminal of the third element is brought to an appropriate fixed level, so the internal power supply voltage does not fluctuate significantly.

Yet another step-down power supply meeting the second object of the invention also includes a reference voltage generator, a control circuit, and a stepped-down voltage output circuit with first, second, and third elements that conduct current as described above. The stepped-down voltage output circuit also has a circuit that raises the reference voltage by a first predetermined amount for a first predetermined time when the step-down control signal is switched from the first level to the second level, and lowers the reference voltage by a second predetermined amount for a second predetermined time when the control signal is switched from the second level to the first level.

The raising and lowering of the reference voltage oppose the changes caused by the capacitive coupling through the first element noted above, so that after being raised or lowered, the reference voltage quickly returns to its normal level. Consequently, the internal power supply voltage does not fluctuate significantly.

DETAILED DESCRIPTION OF THE INVENTION

Figure 1:
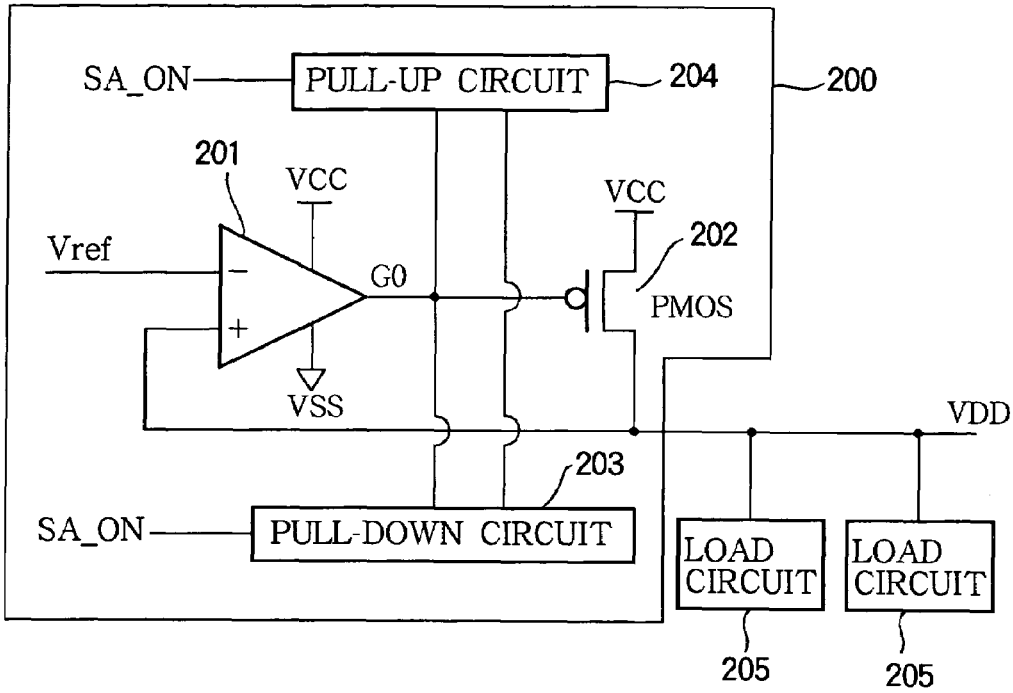
FIG. 1 is a circuit diagram of a step-down power supply illustrating a first embodiment of the invention.

Embodiments of the invention will now be described with reference to the attached drawings, in which like elements are indicated by analogous reference characters.

First Embodiment

A step-down power supply that meets the first object of the present invention is shown in FIG. 1. This step-down power supply 200, which comprises a differential amplifier 201, a PMOS transistor 202, a pull-down circuit 203, and a pull-up circuit 204, is integrated into a semiconductor memory chip with internal load circuits 205 including sense amplifiers that amplify memory cell voltages. The step-down power supply 200 receives power from an external source at a voltage VCC and supplies the power at a lower internal voltage VDD to the load circuits 205. The PMOS transistor 202 functions as the load driver, receiving VCC at its input terminal or source terminal and supplying VDD from its output terminal or drain terminal to an internal power supply node to which the load circuits 205 are connected. The differential amplifier 201 compares the internal power supply voltage VDD with a reference voltage Vref and adjusts the conductivity of the PMOS transistor 202 so as to hold VDD equal to Vref. The output terminal of the differential amplifier 201 is connected to the control terminal or gate terminal of the PMOS transistor 202 through a control node G0. The power supply voltage drop (VCC−VDD) in the PMOS transistor 202 varies in response to the gate voltage of the PMOS transistor 202 (the voltage at the control node G0) and the amount of current conducted (IVDD).

Transistor input, output, and control terminals will be referred to hereinafter simply as the source, drain, and gate. The source and drain are the current-conducting terminals, one being the input terminal, the other the output terminal. Either the source or drain may be the input terminal. The gate is the control terminal that controls the conductivity of the transistor.

The pull-down circuit 203 receives a sense amplifier activation signal (SA_ON), generated by an external control circuit not shown in the drawing, and responds by temporarily pulling down the voltage of the control node G0. The pull-up circuit 204 then temporarily pulls up the voltage of the control node G0.

Figure 2A:
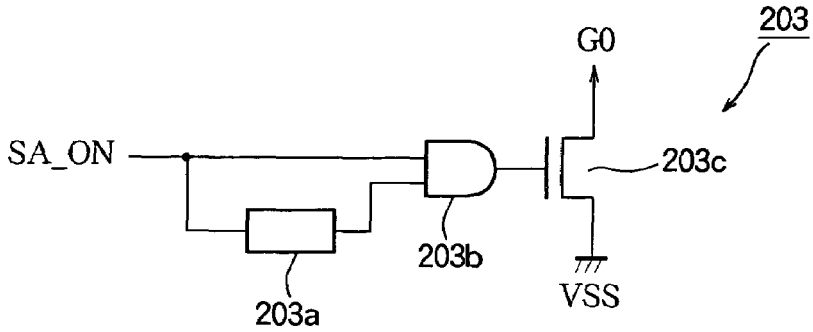
FIG. 2A shows the internal circuit configuration of the pull-down circuit in FIG. 1.

Referring to FIG. 2A, the pull-down circuit 203 includes a pull-down signal generator 203*a*, an AND gate 203*b*, and an NMOS transistor 203*c*. The pull-down signal generator 203*a* generates a pull-down pulse signal having a predetermined high pulse width when the sense amplifier activation signal SA_ON goes high. The AND gate 203*b* takes the logical AND of the pull-down pulse signal and the sense amplifier activation signal SA_ON. The NMOS transistor 203*c* has its gate connected to the output of the AND gate 203*b*, its drain connected to the control node G0, and its source connected to ground (VSS).

Figure 2B:
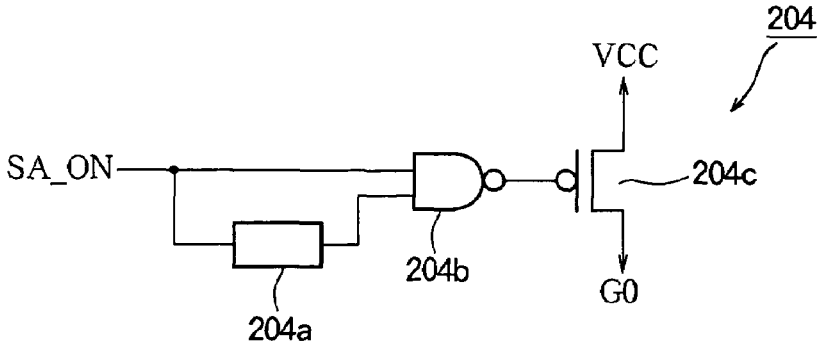
FIG. 2B shows the internal circuit configuration of the pull-up circuit in FIG. 1.

Referring to FIG. 2B, the pull-up circuit 204 includes a pull-up signal generator 204*a*, a NAND gate 204*b*, and a PMOS transistor 204*c*. The pull-up signal generator 204*a* generates a pull-up pulse signal having a predetermined high pulse width when a delay time equal to the pulse width of the pull-down signal has elapsed after the sense amplifier activation signal SA_ON goes high. The NAND gate 204*b* takes the logical NOT-AND of the sense amplifier activation signal SA_ON and the pull-up signal. The PMOS transistor 204*c* has its gate connected to the output of the NAND gate 204*b*, its drain connected to the control node G0, and its source connected to the external VCC source.

Figure 3:
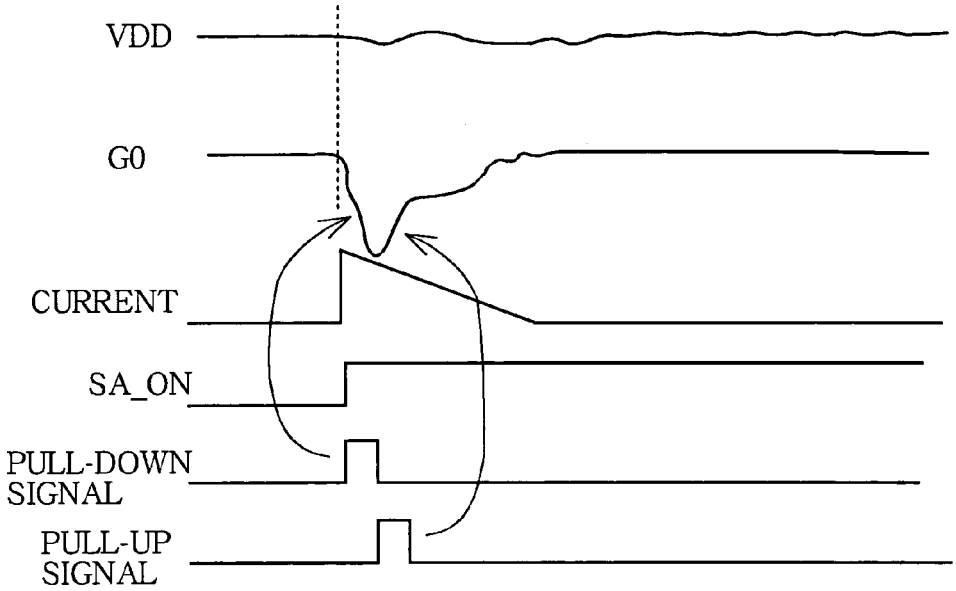
FIG. 3 is a voltage, current, and timing waveform diagram illustrating the operation of the first embodiment.

The operation of the step-down power supply 200 will be described with reference to FIG. 3.

When the sense amplifier activation signal SA-ON goes high, the pull-down signal generator 203*a* in the pull-down circuit 203 generates a pull-down pulse signal with a predetermined high pulse width. The AND gate 203*b* receives the SA_ON signal and the pull-down pulse signal and outputs a high voltage to the gate of NMOS transistor 203*c*. NMOS transistor 203*c* promptly turns on, pulling the voltage at the control node G0 sharply down and quickly increasing the conductivity of the PMOS transistor 202. This action prevents the decrease in the internal power supply voltage VDD that would otherwise result from the abrupt increase in the amount of current drawn by the load circuits 205 when the sense amplifiers starts operating.

Immediately after the pull-down pulse signal goes low, the pull-up signal generator 204*a* brings the pull-up signal high. The NAND gate 204*b* outputs a low voltage to the gate of PMOS transistor 204*c*, which promptly turns on, increasing the voltage at the control node G0 and decreasing the conductivity of PMOS transistor 202. Even if the current drawn by the load circuits 205 when the sense amplifiers start operating immediately decreases after its initial sharp rise, since the conductivity of PMOS transistor 202 also now decreases, the internal power supply voltage VDD does not rise, despite the initial pull-down operation.

In a variation of the first embodiment, the pull-down signal generator 203*a* and pull-up signal generator 204*a* are replaced by inverting delay lines comprising, for example, an odd number of inverters connected in cascade.

Second Embodiment

Figure 4:
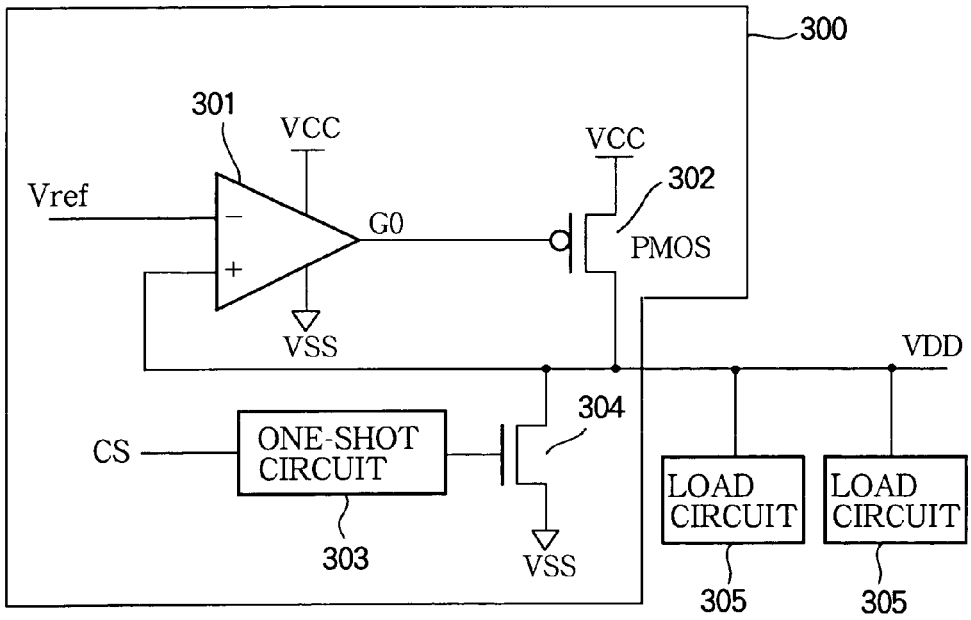
FIG. 4 is a circuit diagram of a step-down power supply illustrating a second embodiment of the invention.

Another step-down power supply that meets the first object of the present invention is shown in FIG. 4.

This step-down power supply 300, which comprises a differential amplifier 301, a PMOS transistor 302, a one-shot circuit 303, and an NMOS transistor 304, is integrated into a semiconductor memory chip with internal load circuits 305. Before the internal load circuits 305 start operating, an external control circuit not shown in the drawing asserts a chip activation signal such as a chip select (CS) signal for activating the chip as a whole. The second embodiment utilizes the chip activation signal.

The step-down power supply 300 receives power from an external source at a voltage VCC and supplies the power at a lower internal voltage VDD to the load circuits 305. The differential amplifier 301 and PMOS transistor 302 are interconnected at a control node G0 and operate in the same way as the corresponding differential amplifier and PMOS transistor in the first embodiment to hold the internal power supply voltage VDD equal to a reference voltage Vref. When the chip activation signal (CS) is asserted, the one-shot circuit 303 outputs a leak signal with a predetermined high pulse width to the gate of NMOS transistor 304. NMOS transistor 304 responds by turning on, allowing current to leak from the internal power supply node or VDD node to ground (VSS) for a predetermined time interval. The one-shot circuit 303 and NMOS transistor 304 form a leak circuit.

Figure 5:
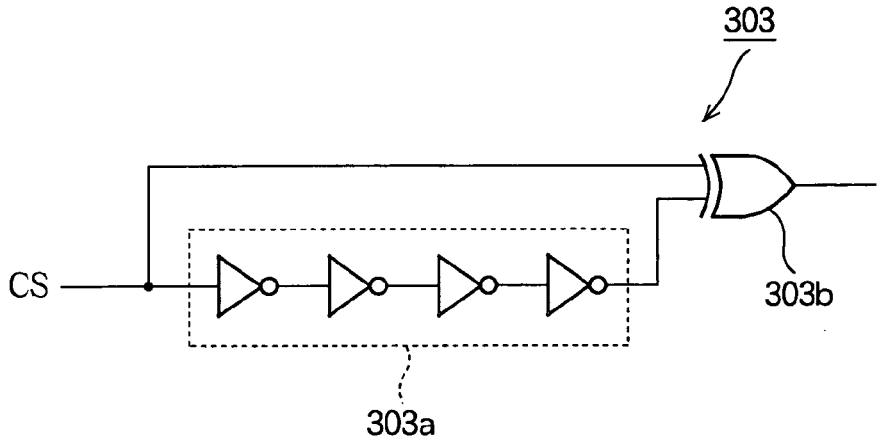
FIG. 5 shows the internal circuit configuration of the one-shot circuit in FIG. 4.

Referring to FIG. 5, the one-shot circuit 303 includes a delay line 303*a* and an exclusive-OR gate 303*b*. The delay line 303*a* contains an even number of inverters connected in cascade, and outputs a delayed CS signal. The exclusive-OR gate 303*b* receives both the CS signal and the delayed CS signal and outputs the leak signal.

The operation of the step-down power supply 300 will be described with reference to FIG. 6. The dotted lines indicate the VDD and G0 waveforms that could be produced without the one-shot circuit 303 and NMOS transistor 304. When the CS signal goes-high, noise effects may cause VDD to remain near the VCC level, in which case the G0 potential also remains near the VCC level. When the load circuits 305 are activated and suddenly start to draw a large amount of current, VDD falls steeply. The G0 potential also falls, but as the fall starts from a level near VCC, at first PMOS transistor 302 remains substantially turned off. The fall in the G0 potential slightly lags the fall in VDD, due to the limited response speed of the differential amplifier 301. Eventually G0 falls far enough to turn on PMOS transistor 302 to a significant degree and halt the drop in the VDD level, but in the meantime VDD has gone far below its normal level, and the ensuing rise of VDD back toward the normal level takes additional time, so there is an extended droop in the VDD potential.

Figure 6:
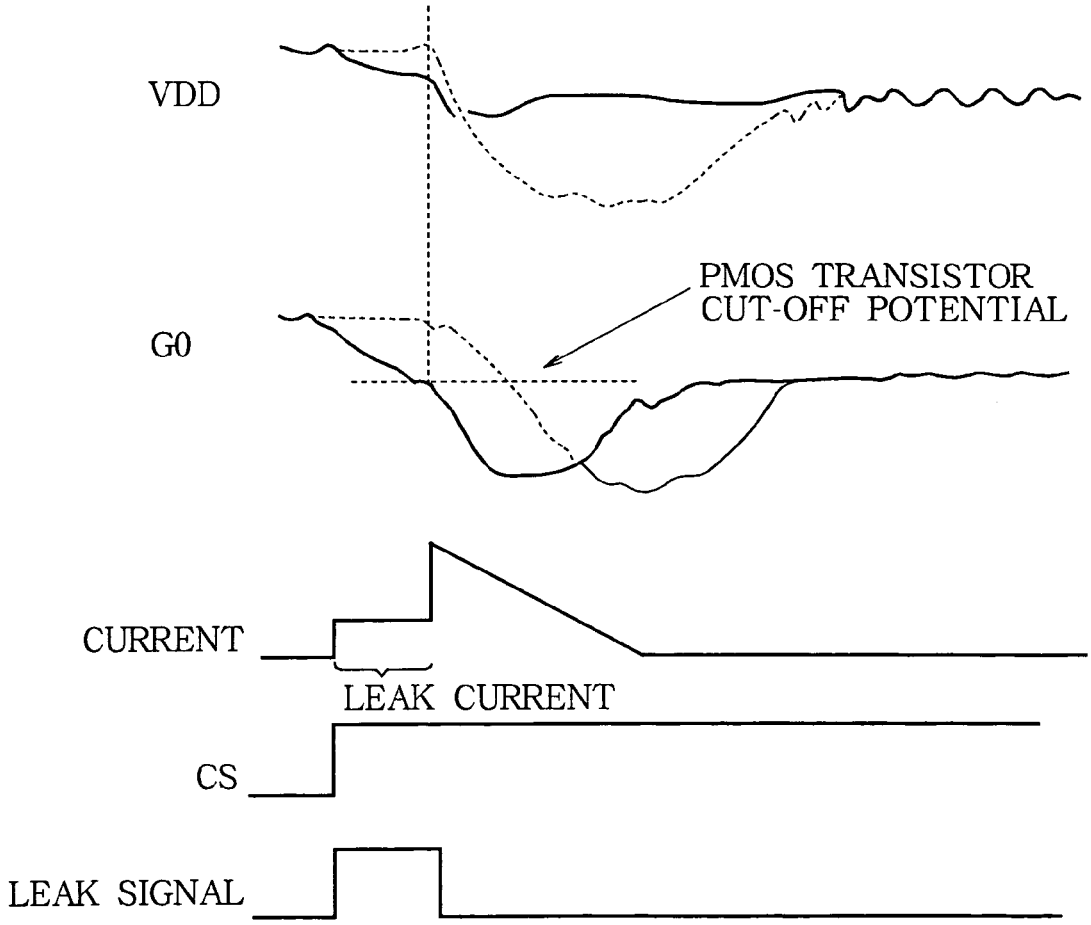
FIG. 6 is a voltage, current, and timing waveform diagram illustrating the operation of the second embodiment.

The presence of the one-shot circuit 303 and NMOS transistor 304 changes the behavior of VDD and G0 from the dotted waveforms in FIG. 6 to the waveforms indicated by solid lines. When the CS signal goes high, the one-shot circuit 303 drives the leak signal high for a predetermined interval, turning on NMOS transistor 304 to let current leak from the VDD node to ground (VSS) before the current drawn by the load circuits 305 increases. The internal supply voltage VDD decreases, but the leakage through NMOS transistor 304 is not large enough to cause a sharp decrease in the VDD level, and the differential amplifier 301 has time to bring the voltage at the control node G0 down to a point near the cut-off potential of PMOS transistor 302 before VDD goes below its normal level. When the load circuits 305 are activated and begin to draw substantial current, VDD drops further, but the resulting further drop in the G0 level quickly increases the conductivity of PMOS transistor 302. This increase is sufficient to halt the drop in the VDD level at a point near the reference voltage level. Thereafter, VDD remains substantially steady at this level.

In this embodiment, the initial leakage of current from the VDD node to ground gives the differential amplifier a head start that prevents the response of the step-down power supply from being degraded by noise and other unwanted effects that may arise when the chip is activated.

Third Embodiment

Figure 7:
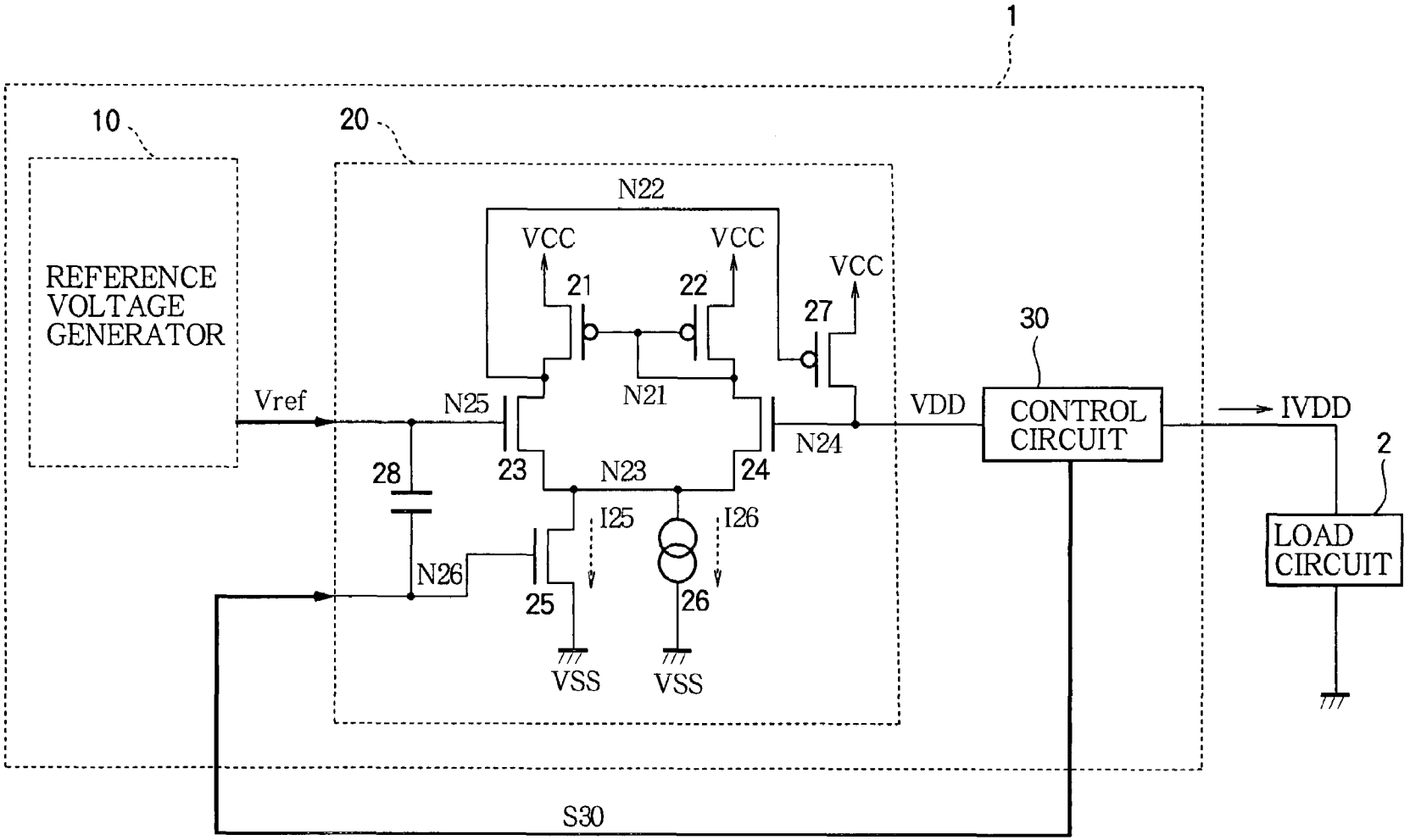
FIG. 7 is a circuit diagram of a step-down power supply illustrating a third embodiment of the invention.

A step-down power supply that meets the second object of the present invention is shown in FIG. 7. This step-down power supply 1 receives power from an external source at a voltage VCC, such as 3.3 V, for example, and supplies the power at a lower internal voltage VDD equal to a reference voltage Vref, such as 2.5 V, for example, to a load circuit 2. The step-down power supply 1 comprises a reference voltage generator 10, a stepped-down voltage output circuit 20, and a control circuit 30. The reference voltage generator 10 generates the reference voltage Vref. The control circuit 30 switches a step-down control signal S30 between high and low logic levels according to the amount of current IVDD drawn by the load circuit 2. The step-down control signal S30 is high when IVDD is high and low when IVDD is low. Descriptions of the internal structure of the reference voltage generator 10 and control circuit 30 will be omitted so as not to obscure the invention with unnecessary detail.

The stepped-down voltage output circuit 20 receives the reference voltage Vref and step-down control signal S30 and outputs the internal power supply voltage VDD. The stepped-down voltage output circuit 20 comprises PMOS transistors 21, 22, 27, NMOS transistors 23, 24, 25, and a constant-current source 26. PMOS transistor 21 has its source connected to the external VCC source, its drain connected to a node N22, and its gate connected to a node N21. PMOS transistor 22 has its source connected to the external VCC source, and its drain and gate connected to node N21. NMOS transistor 23 has its source connected to a node N23, its drain connected to node N22, and its gate connected to a node N25. NMOS transistor 24 has its source connected to node N23, its drain connected to node N21, and its gate connected to a node N24. NMOS transistor 25 has its source connected to ground (VSS), its drain connected to node N23, and its gate connected to a node N26. PMOS transistor 27 has its source connected to the external VCC source, its drain connected to node N24, and its gate connected to node N22. The constant-current source 26 is connected between node N23 and ground (VSS). A capacitor 28 is connected between node N25 and node N26. Node N26 receives the step-down control signal S30. Node N25 receives the reference voltage Vref. Node N24 is the internal power supply node from which the internal power supply voltage VDD is output through the control circuit 30 to the load circuit 2.

Figure 17:
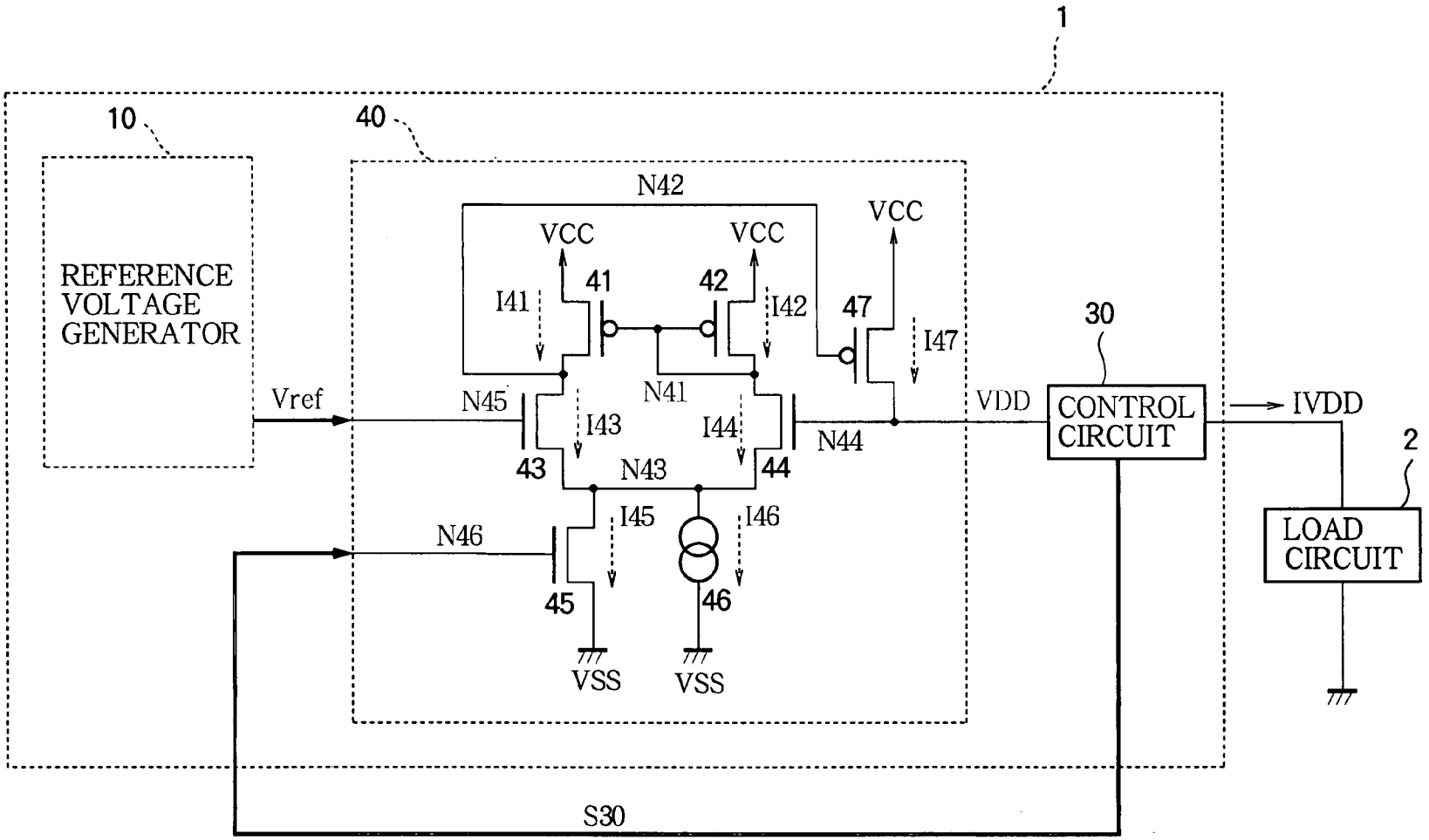
FIG. 17 is a circuit diagram of a further conventional step-down power supply.
Figure 18:
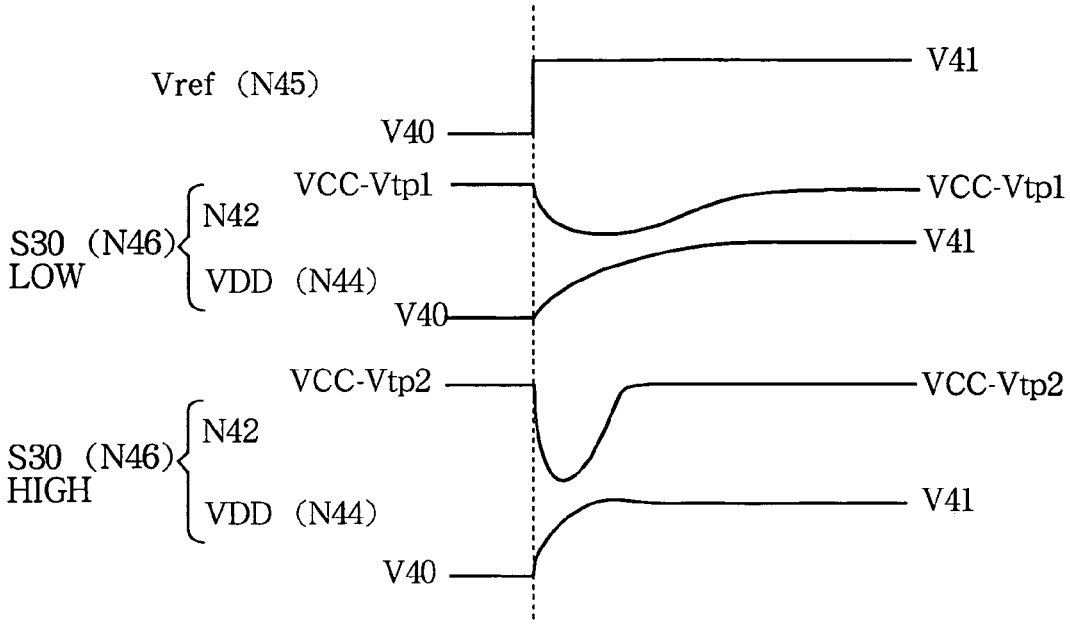
FIG. 18 is a voltage and timing waveform diagram illustrating the operation of the stepped-down voltage output circuit in FIG. 17.
Figure 19:
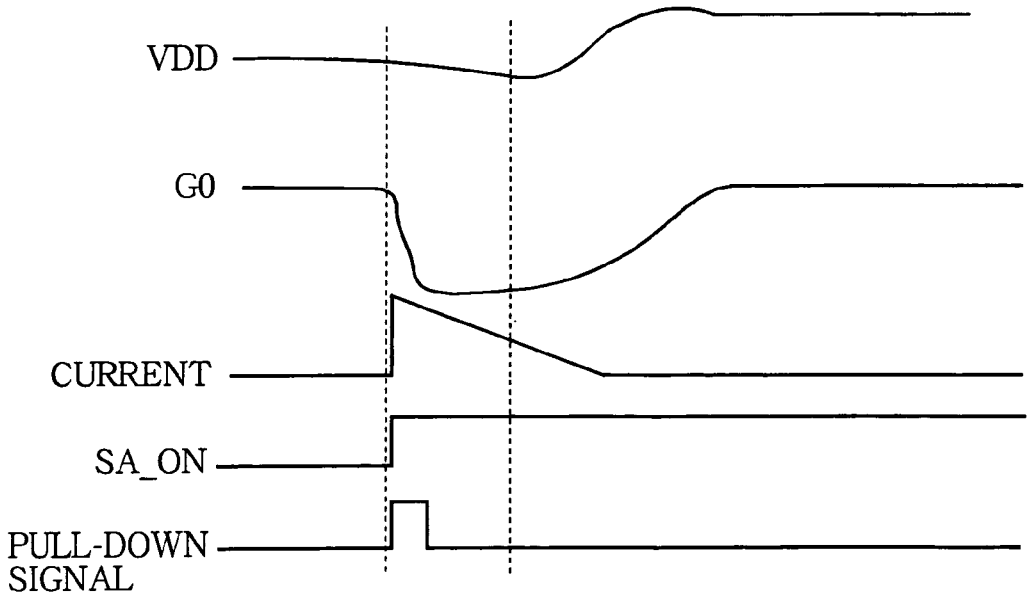
FIG. 19 is a voltage, current, and timing waveform diagram illustrating the operation of the conventional step-down power supply in FIG. 15.

In this stepped-down voltage output circuit 20, NMOS transistor 23 functions as the first element, NMOS transistor 25 as the second element, and PMOS transistor 27 as the third element. The step-down power supply 1 in FIG. 7 is identical to the conventional step-down power supply in FIG. 17 except for the additional capacitor 28.

Figure 8:
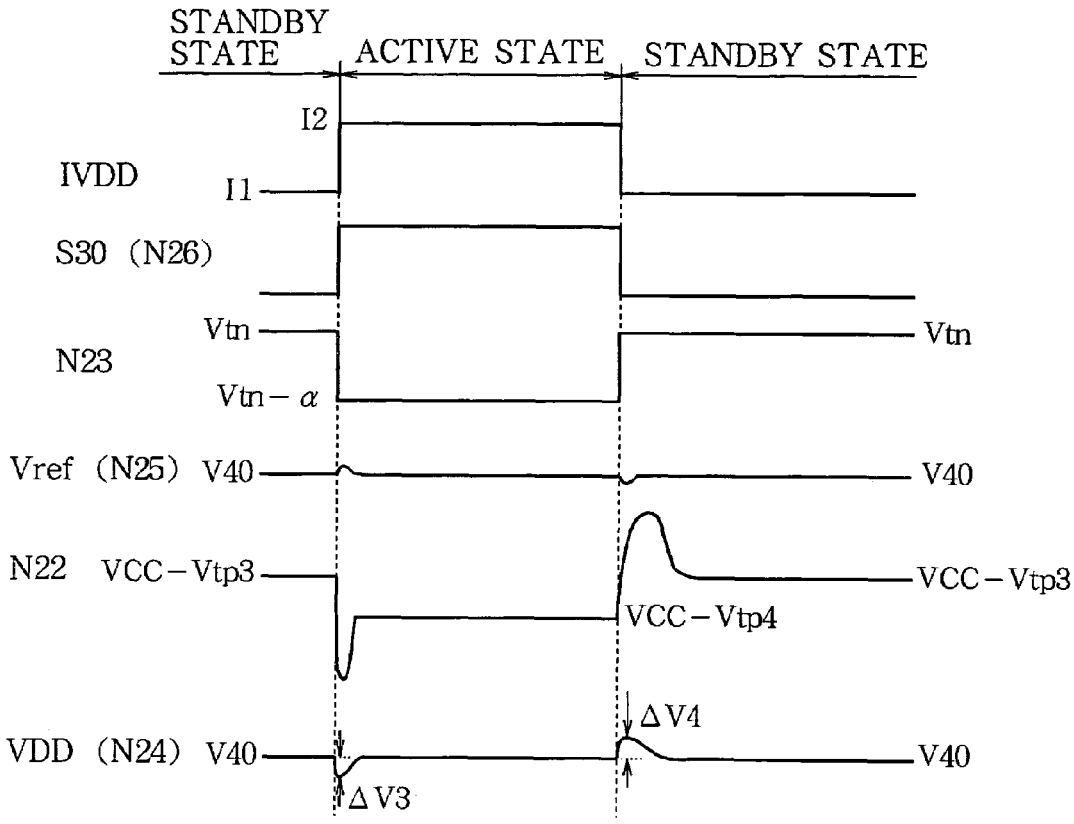
FIG. 8 is a voltage, current, and timing waveform diagram illustrating the operation of the stepped-down voltage output circuit in FIG. 7.
Figure 20:
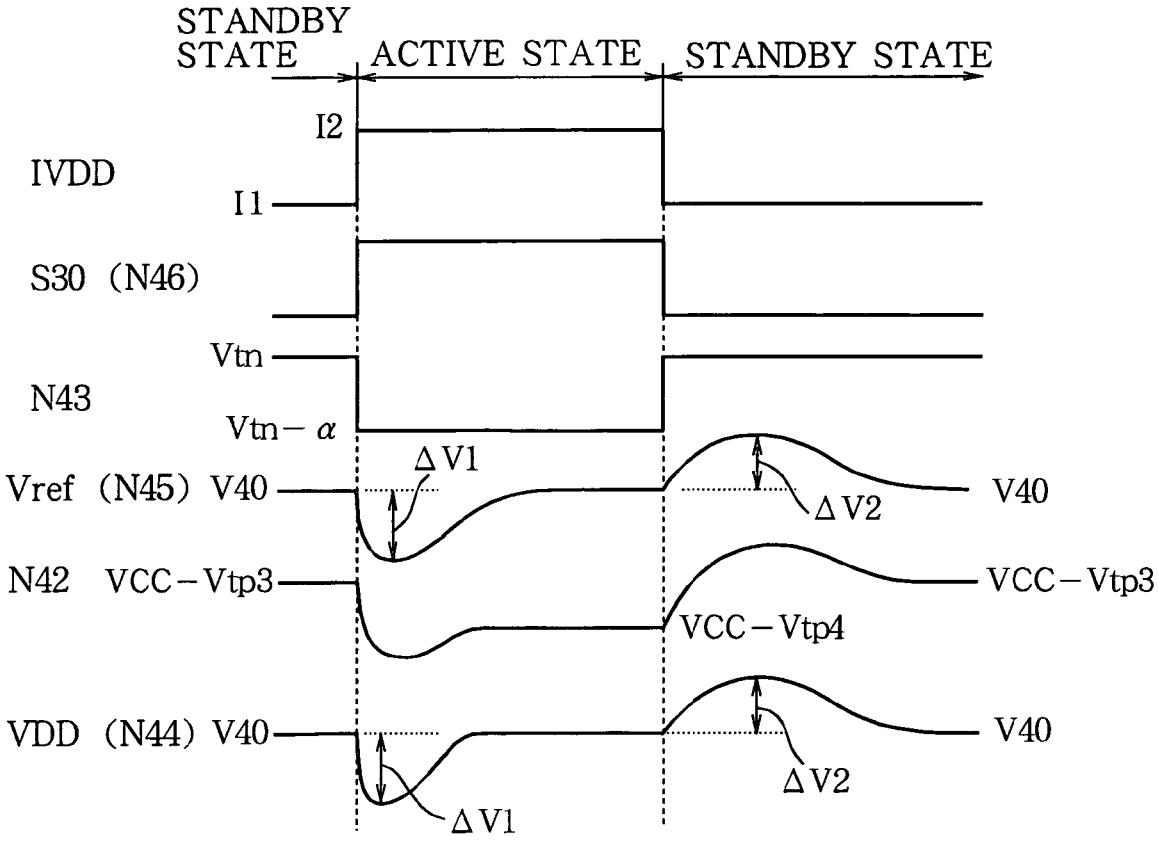
FIG. 20 is another voltage, current, and timing waveform diagram illustrating the operation of the stepped-down voltage output circuit in FIG. 17.

The operation of the step-down power supply 1 in FIG. 7 is illustrated by the waveforms in FIG. 8, using the same notation as in FIG. 20.

The load circuit 2 draws current IVDD equal to I1 in the standby state and I2 in the active state. When the load circuit 2 enters the active state, IVDD abruptly increases from I1 to I2, causing the step-down control signal S30 to go high. The current flowing between node N23 and ground (VSS) abruptly increases from I26 to I26+I25 and the voltage at node N23 abruptly decreases from a value Vtn to a lower value Vtn−α, where α depends on the characteristics of the PMOS and NMOS transistors used. The voltage drop at node N23 is coupled through the gate-source capacitance of NMOS transistor 23 to node N25, but the voltage rise on the S30 signal line is also coupled to node N25, through capacitor 28. The effects of the coupled voltage drop and the coupled voltage rise substantially cancel out, so that the reference voltage Vref at node N25 remains substantially unchanged at V40, instead of falling temporarily by the amount ΔV1 shown in FIG. 20.

The increased current flow through PMOS transistor 21 drops the voltage at node N22 abruptly from VCC−Vtp3 (its normal value in the standby state) to a lower level. The potential drop at node N22 is even greater than the corresponding potential drop at node N42 in FIG. 20, because node N25 remains at the V40 level, but feedback in the stepped-down voltage output circuit 20 quickly brings node N22 up to its normal value in the active state (VCC−Vtp4). During the brief feedback delay, the internal power supply voltage VDD temporarily drops by an amount ΔV3, but this amount is far smaller than the drop ΔV1 in FIG. 20, and VDD also quickly returns to the V40 level.

When the load circuit 2 returns to the standby state and its current draw IVDD decreases from I2 to I1, the step-down control signal S30 goes low, causing the current flowing between node N23 and ground (VSS) to decrease from I26+I25 to I26 and the voltage at node N23 to increase from Vtn−α to Vtn. The voltage rise at node N23 is coupled through the gate-source capacitance of NMOS transistor 23 to node N25, but the effect of this rise is canceled by the effect of the drop in the S30 voltage, which is coupled to node N25 through capacitor 28. Accordingly, the reference voltage Vref at node N25 remains substantially constant at V40, and the internal power supply voltage VDD rises by just ΔV4 (an amount far smaller than corresponding rise ΔV2 in FIG. 20) before quickly being restored to the V40 level.

The effect of the additional capacitor 28 interconnecting nodes N25 and N26 is thus to keep the reference voltage Vref at its normal V40 level when the step-down control signal S30 switches between the high level and the low level, thereby greatly reducing the temporary fluctuations in the internal power supply voltage VDD that occur at transitions of the load circuit 2 between the active state and the standby state. The load circuit 2 accordingly does not suffer temporary degradation of its response speed, timing margin, or input voltage margin to a degree that might lead to malfunction.

Fourth Embodiment

Figure 9:
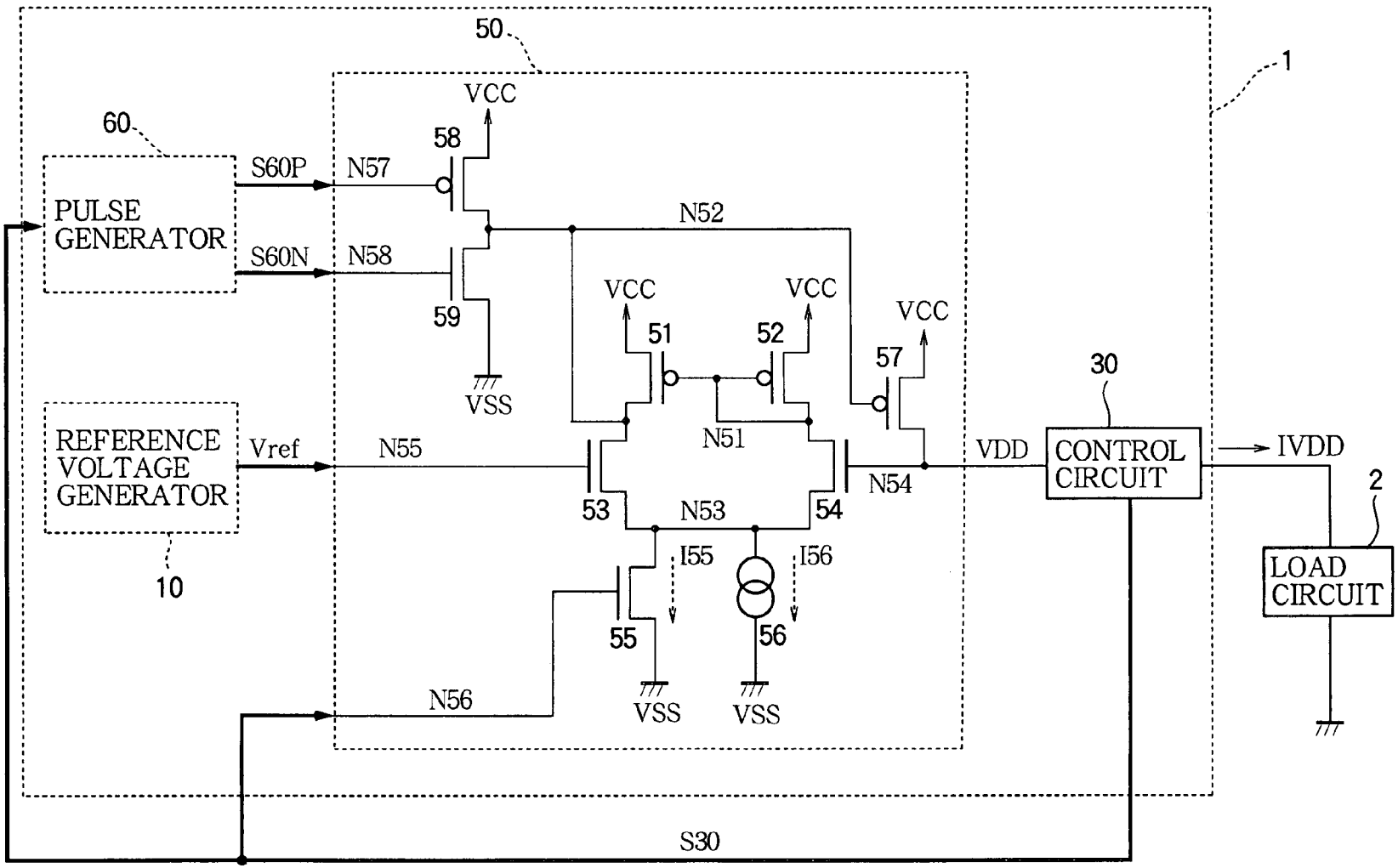
FIG. 9 is a circuit diagram of a step-down power supply illustrating a fourth embodiment of the invention.

Another step-down power supply that meets the second object of the present invention is shown in FIG. 9. This step-down power supply 1 comprises a reference voltage generator 10, a control circuit 30, a stepped-down voltage output circuit 50, and a pulse generator 60. The reference voltage generator 10 and control circuit 30 operate as in the third embodiment, the reference voltage generator 10 generating a reference voltage Vref, the control circuit 30 generating a step-down control signal S30 that switches between high and low logic levels according to an amount of current IVDD drawn by the load circuit 2.

The pulse generator 60 receives the step-down control signal S30 and generates a pair of pulse signals S60N and S60P. S60N is normally low but goes high for a predetermined interval t1 when the step-down control signal S30 goes high. S60P is normally high but goes low for a predetermined interval t2 when the step-down control signal S30 goes low. A description of the internal structure of the pulse generator 60 will be omitted, as pulse-generating circuits are well known.

The stepped-down voltage output circuit 50 receives the reference voltage Vref, the step-down control signal S30, and the pulse signals S60N and S60P, and outputs the internal power supply voltage VDD. The stepped-down voltage output circuit 50 comprises PMOS transistors 51, 52, 57, 58, NMOS transistors 53, 54, 55, 59, and a constant-current source 56. PMOS transistor 51 has its source connected to an external VCC source, its drain connected to a node N52, and its gate connected to a node N51. PMOS transistor 52 has its source connected to the external VCC source and its drain and gate connected to node N51. NMOS transistor 53 has its source connected to a node N53, its drain connected to node N52, and its gate connected to a node N55. NMOS transistor 54 has its source connected to node N53, its drain connected to node N51, and its gate connected to node N54. NMOS transistor 55 has its source connected to ground (VSS), its drain connected to node N53, and its gate connected to a node N56. PMOS transistor 57 has its source connected to the external VCC source, its drain connected to node N54, and its gate connected to node N52. PMOS transistor 58 has its source connected to the external VCC source, its drain connected to node N52, and its gate connected to a node N57. NMOS transistor 59 has its source connected to ground (VSS), its drain connected to node N52, and its gate connected to a node N58. The constant-current source 56 is connected between ground (VSS) and node N53. Node N55 receives the reference voltage Vref, and node N56 receives the step-down control signal S30. Node N57 receives the pulse signal S60P, and node N58 receives the pulse signal S60N. Node N54 is the internal power supply node from which the internal power supply voltage VDD is output through the control circuit 30 to the load circuit 2.

In this stepped-down voltage output circuit 50, NMOS transistor 53 functions as the first element, NMOS transistor 55 as the second element, and PMOS transistor 57 as the third element. The stepped-down voltage output circuit 50 is identical to the conventional stepped-down voltage output circuit in FIG. 17 except for the additional PMOS transistor 58 and NMOS transistor 59.

Figure 10:
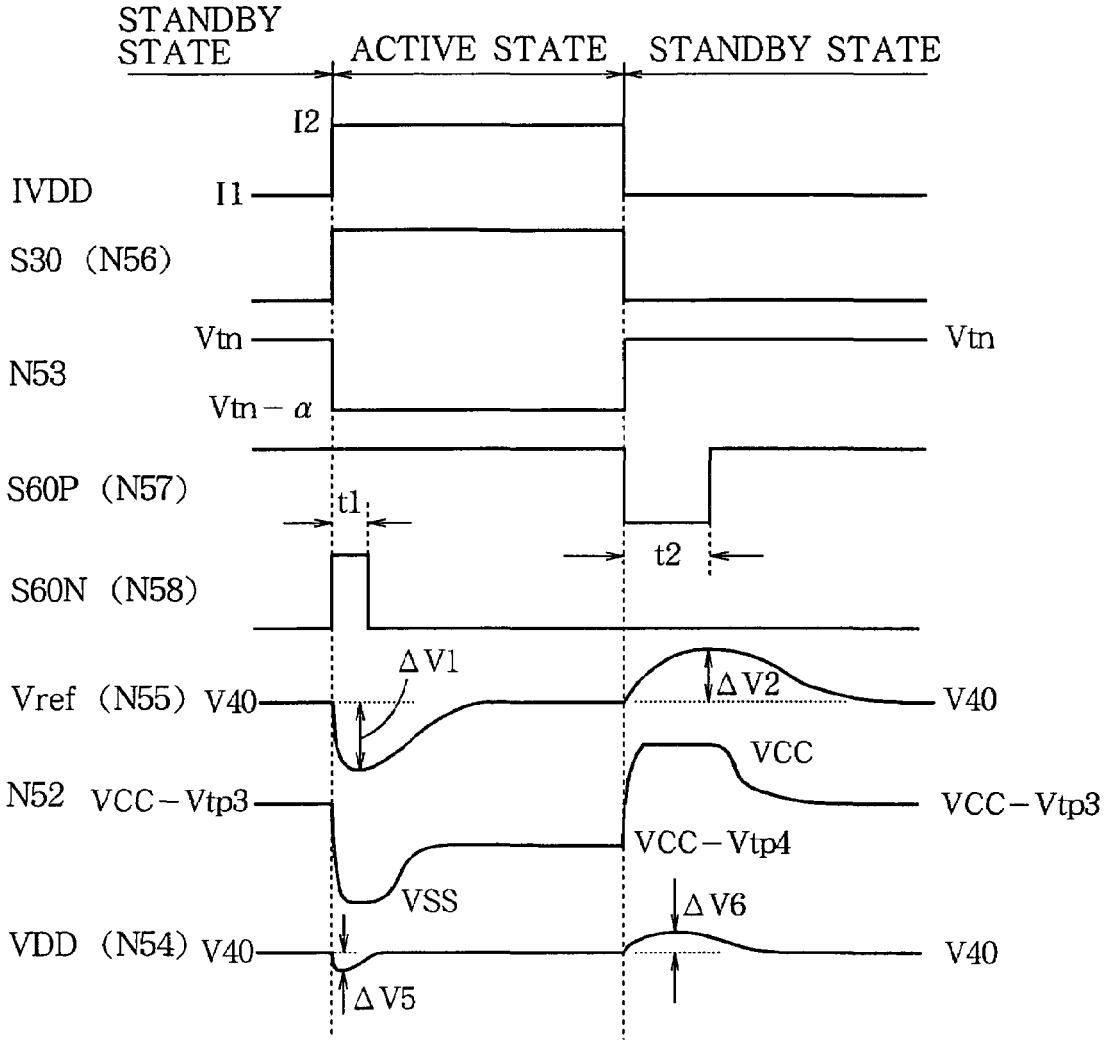
FIG. 10 is a voltage, current, and timing waveform diagram illustrating the operation of the stepped-down voltage output circuit in FIG. 9.

The operation of the step-down power supply 1 in FIG. 9 is illustrated by the waveforms in FIG. 10, using the same notation as in FIG. 20.

The load circuit 2 draws current IVDD equal to I1 in the standby state and I2 in the active state. When the load circuit 2 is activated, IVDD abruptly increases from I1 to I2, causing the step-down control signal S30 to go high. The current flowing between node N53 and ground (VSS) abruptly increases from I56 to I56+I55 and the voltage at node N53 abruptly decreases from a value Vtn to a lower value Vtn−α, where α depends on the characteristics of the PMOS and NMOS transistors used. The voltage drop at node N53 is coupled through the gate-source capacitance of NMOS transistor 53 to node N55, where the reference voltage Vref decreases temporarily from V40 to V40−ΔV1, as in FIG. 20.

Simultaneously, because the step-down control signal S30 has gone high, the pulse generator 60 activates pulse signal S60N, supplying a high pulse to node N58, and NMOS transistor 59 is turned on for the duration (t1) of this pulse. The voltage at node N52 is therefore pulled down from VCC−Vtp3 to VSS for a period of time t1. Because this drop in the potential at node N52 is greater than the corresponding drop in the potential of node N42 in FIG. 20, PMOS transistor 57 is turned on more fully, and the internal power supply voltage VDD decreases by just ΔV5 instead of by the larger amount ΔV1 in FIG. 20. The decrease is also brief; by the end of time t1, VDD has already returned to the V40 level. After time t1, normal feedback control in the stepped-down voltage output circuit 50 operates to return the potential at node N52 to its usual level (VCC−Vtp4) in the active state, and hold the internal power supply voltage VDD at the same level as the reference voltage Vref, which has by then also returned to V40.

When the load circuit 2 returns to the standby state and its current draw IVDD decreases from I2 to I1, the step-down control signal S30 goes low, causing the current flowing between node N53 and ground (VSS) to decrease from I56+I55 to I56 and the voltage at node N53 to increase from Vtn−α to Vtn. The voltage rise at node N53 is coupled through the gate-source capacitance of NMOS transistor 53 to node N55, causing the reference voltage Vref to increases temporarily from V40 to V40+ΔV2, as in FIG. 20.

Simultaneously, because the step-down control signal S30 has gone low, the pulse generator 60 activates pulse signal S60P, supplying a low pulse to node N57, and PMOS transistor 58 is turned on for the duration (t2) of this pulse. The voltage at node N52 is therefore pulled up from VCC−Vtp4 to VCC for a period of time t2, during which PMOS transistor 57 is substantially turned off. Before PMOS transistor 57 turns off completely, the internal power supply voltage VDD increases by ΔV6, but this is far smaller than the corresponding increase ΔV2 in FIG. 20, and the small amount of current IVDD still drawn by the load circuit 2 pulls VDD back down toward the normal V40 level. At the end of time t2, normal feedback in the stepped-down voltage output circuit 50 operates to return the potential at node N52 to its usual level (VCC−Vtp3) in the standby state, and hold the internal power supply voltage VDD at the same level as the reference voltage Vref, which has by then also returned to V40.

Time t2 is longer than time t1, because when the load circuit 2 is active, feedback control by the stepped-down voltage output circuit 50 must commence comparatively quickly to maintain the proper VDD level, while when the load circuit 2 is inactive and not drawing significant current, VDD will remain near the proper level even if PMOS transistor 57 is left switched off for a while.

In the fourth embodiment, PMOS transistor 58 and NMOS transistor 59 are turned on for predetermined periods, during which the node N52 is held at the ground level VSS or the external power supply level VCC to suppress the temporarily drop or rise in the internal power supply voltage VDD that would otherwise occur due to fluctuations in the reference voltage Vref immediately after a transition of the load circuit 2 between the active and standby states. The load circuit 2 accordingly does not suffer temporary degradation of its response speed, timing margin, or input voltage margin to a degree that might lead to malfunction.

Fifth Embodiment

Figure 11:
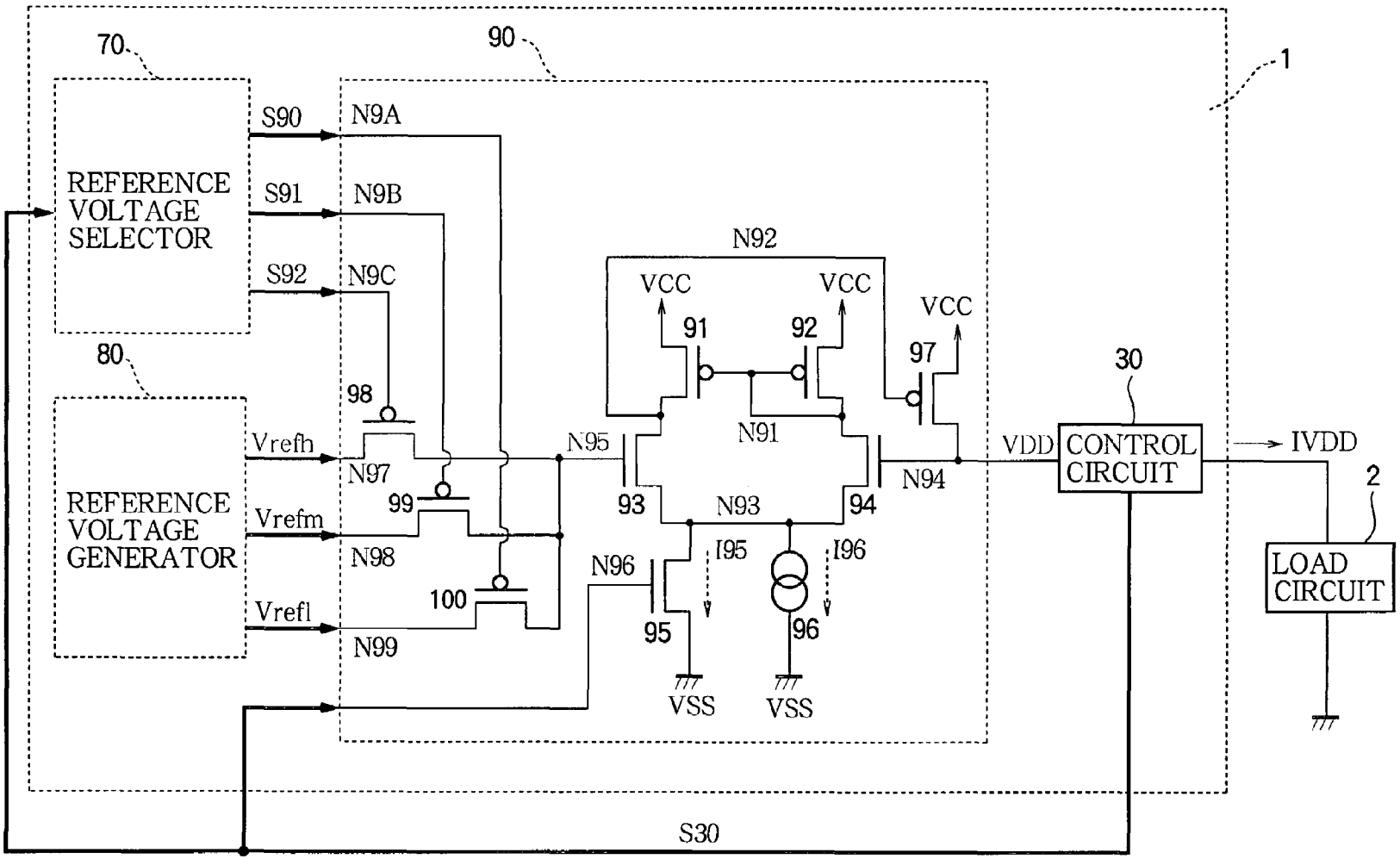
FIG. 11 is a circuit diagram of a step-down power supply illustrating a fifth embodiment of the invention.

A further step-down power supply that meets the second object of the present invention is shown in FIG. 11. This step-down power supply 1 comprises a control circuit 30, a reference voltage selector 70, a reference voltage generator 80, and a stepped-down voltage output circuit 90. The control circuit 30 generates a step-down control signal S30 that switches between high and low levels according to the amount of current drawn by the load circuit 2 as in the third and fourth embodiments. The reference voltage selector 70 receives the step-down control signal S30 and outputs three reference-voltage select signals S90, S91, and S92. The reference voltage generator 80 generates three different reference voltages Vrefh, Vrefm, and Vrefl. The stepped-down voltage output circuit 90 receives the step-down control signal S30, the reference voltages Vrefh, Vrefm, and Vrefl, and the reference-voltage select signals S90, S91, and S92 and outputs the internal power supply voltage VDD.

The stepped-down voltage output circuit 90 comprises PMOS transistors 91, 92, 97, 98, 99, 100, NMOS transistors 93, 94, 95, and a constant-current source 96. PMOS transistor 91 has its source connected to the external VCC source, its drain connected to a node N92, and its gate connected to a node N91. PMOS transistor 92 has its source connected to the external VCC source and its drain and gate connected to node N91. NMOS transistor 93 has its source connected to a node N93, its drain connected to node N92, and its gate connected to a node N95. NMOS transistor 94 has its source connected to node N93, its drain connected to node N91, and its gate connected to a node N94. NMOS transistor 95 has its source connected to ground (VSS), its drain connected to node N93, and its gate connected to a node N96. The constant-current source 96 is connected between ground (VSS) and node N93. PMOS transistor 97 has its source connected to the external VCC source, its drain connected to node N94, and its gate connected to node N92. PMOS transistor 98 has its source connected to a node N97, its drain connected to node N95, and its gate connected to a node N9C. PMOS transistor 99 has its source connected to a node N98, its drain connected to node N95, and its gate connected to a node N9B. PMOS transistor 100 has its source connected to node N99, its drain connected to node N95, and its gate connected to a node N9A. Node N96 receives the step-down control signal S30, node N97 receives reference voltage Vrefh, node N98 receives reference voltage Vrefm, and node N99 receives reference voltage Vrefl. Node N9A receives reference-voltage select signal S90, node N9B receives reference-voltage select signal S91, and node N9C receives reference-voltage select signal S92. Node N94 is the internal power supply node from which the internal power supply voltage VDD is output through the control circuit 30 to the load circuit 2.

In this stepped-down voltage output circuit 90, NMOS transistor 93 functions as the first element, NMOS transistor 95 as the second element, and PMOS transistor 97 as the third element. The stepped-down voltage output circuit 90 is identical to the conventional stepped-down voltage output circuit in FIG. 17 except for the additional NMOS transistors 98, 99, 100.

Figure 12:
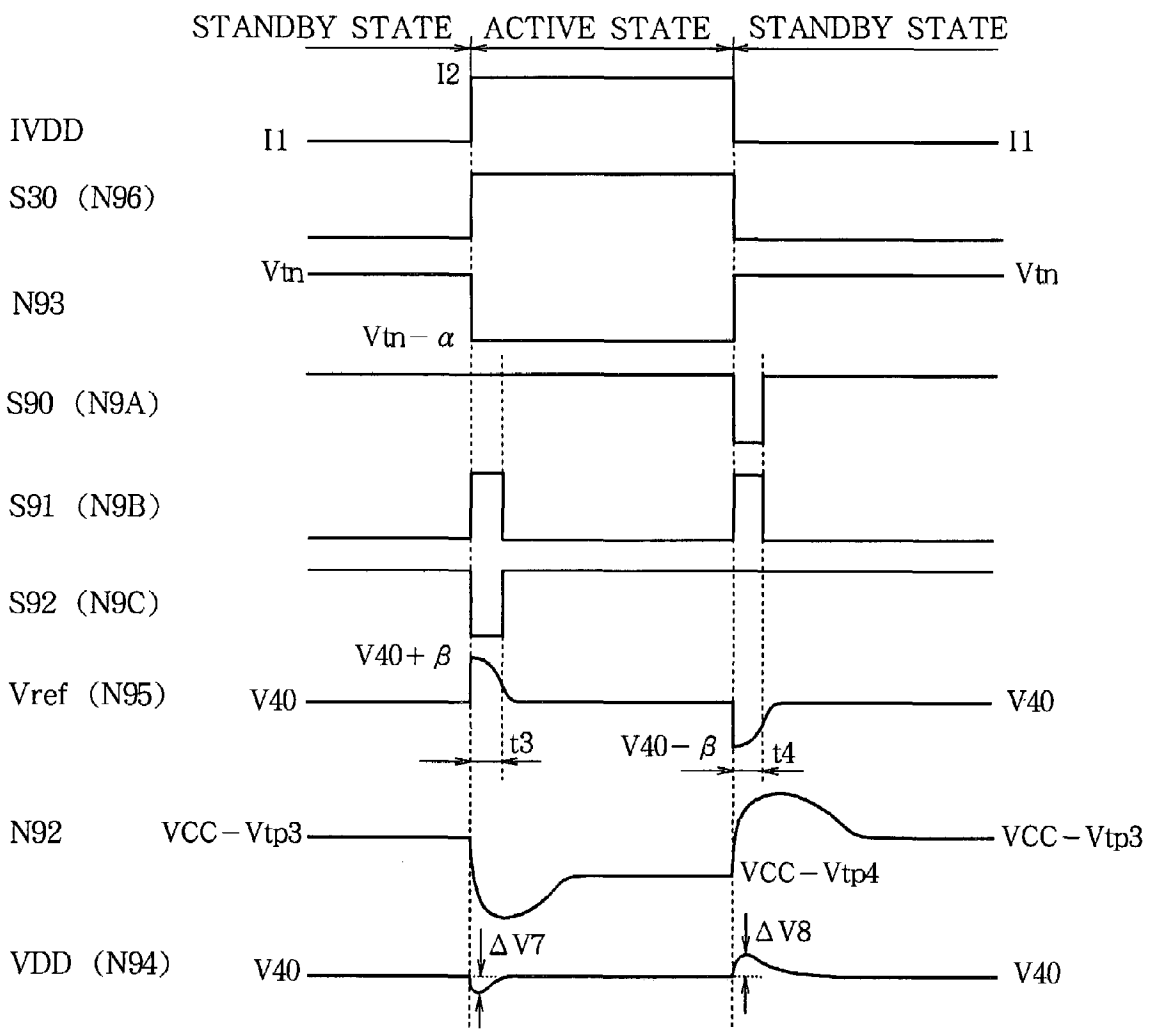
FIG. 12 is a voltage, current, and timing waveform diagram illustrating the operation of the stepped-down voltage output circuit in FIG. 11.
Figure 13:
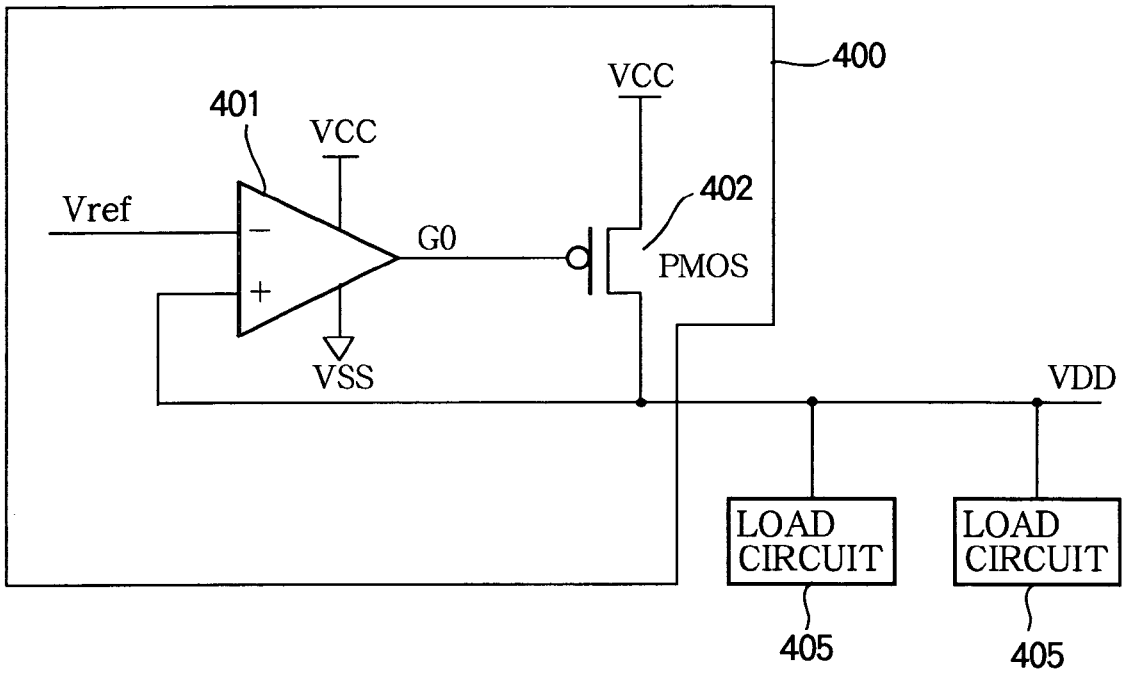
FIG. 13 is a circuit diagram of a conventional step-down power supply.
Figure 14:
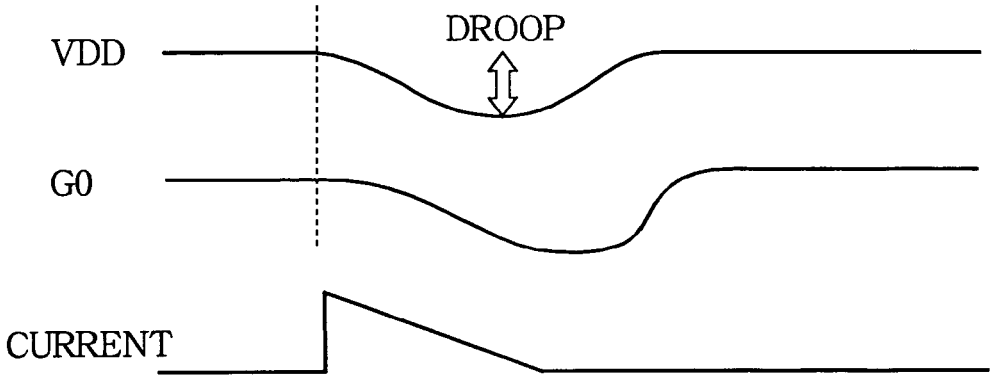
FIG. 14 is a voltage, current, and timing waveform diagram illustrating the operation of the conventional step-down power supply shown in FIG. 13.
Figure 15:
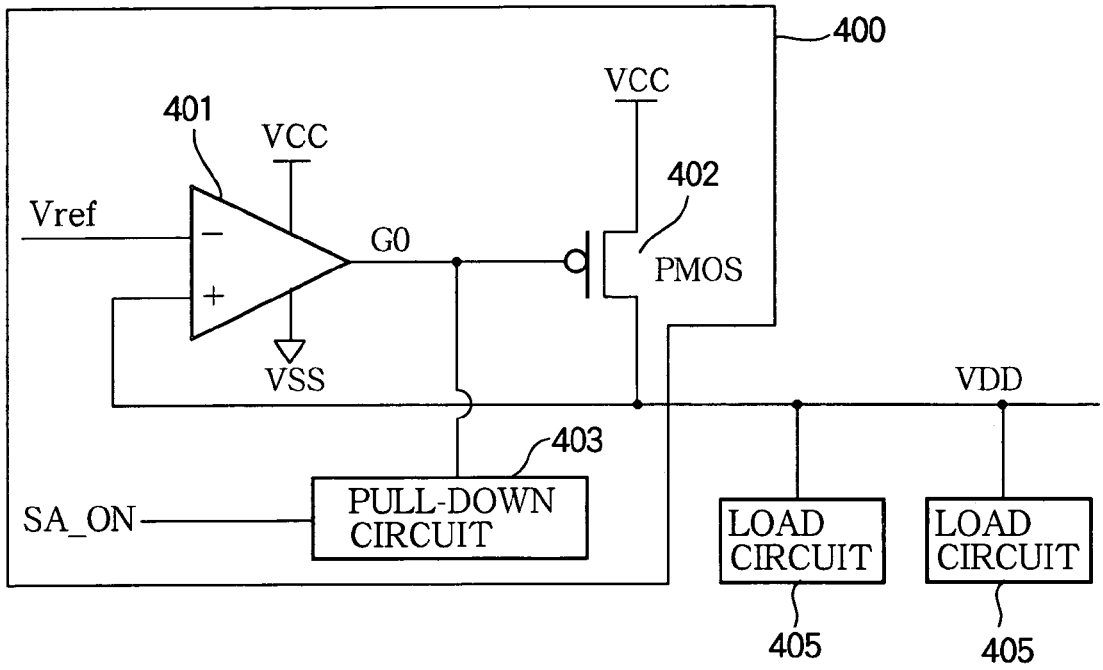
FIG. 15 is a circuit diagram of another conventional step-down power supply.
Figure 16:
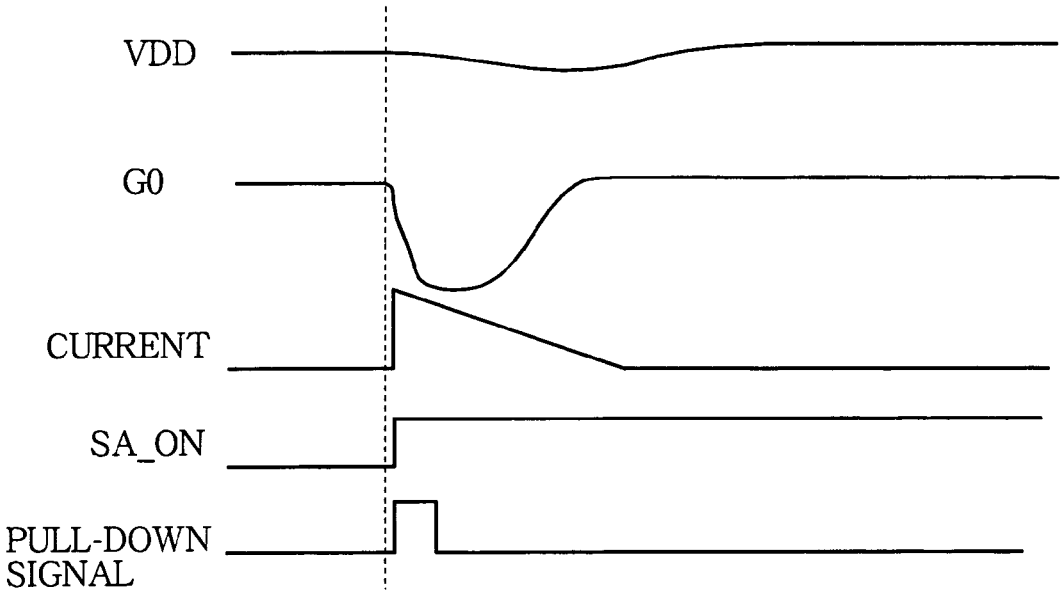
FIG. 16 is a voltage, current, and timing waveform diagram illustrating the operation of the conventional step-down power supply shown in FIG. 15.

The operation of the step-down power supply 1 in FIG. 11 is illustrated by the waveforms in FIG. 12.

The reference voltage generator 80 outputs a voltage V40 as reference voltage Vrefm, a voltage V40+β as reference voltage Vrefh, and a voltage V40−β as reference voltage Vrefl, where β is a predetermined positive value. Of the reference-voltage select signals, S90 and S92 are normally inactive (high) and S91 is normally active (low), so node N95 normally receives reference voltage Vrefm (V40).

When the load circuit 2 enters the active state and the current IVDD drawn by the load circuit 2 increases from I1 to I2, the step-down control signal S30 goes high. This causes the current between node N93 and ground (VSS) to increase from I96 to I96+I95, decreasing the voltage at node N93 from Vtn to Vtn−α. Because of the gate-source capacitance of NMOS transistor 93, the voltage drop at node N93 is coupled to node N95. In FIG. 20 this caused the reference voltage Vref to decrease temporarily from V40 to V40−ΔV1, but because the step-down control signal S30 has gone high, the reference voltage selector 70 simultaneously drives reference-voltage select signal S91 high and reference-voltage select signal S92 low for an interval of time t3. During this interval, node N9B is high, node N9C is low, PMOS transistor 98 is turned on, and PMOS transistor 99 is turned off. Instead of dropping to V40−ΔV1, accordingly, the potential at node N95 first rises from V40 to V40+β, then falls back to V40. Because of a feedback response delay, the internal power supply voltage VDD drops briefly, but the drop (ΔV7) is far smaller than drop of ΔV1 in FIG. 20.

When the load circuit 2 returns to the standby state and its current draw IVDD decreases from I2 to I1, the step-down control signal S30 goes low, causing the current flowing between node N93 and ground (VSS) to decrease from I96+I95 to I96 and the voltage at node N93 to increase from Vtn−α to Vtn. The voltage rise at node N53 is coupled through the gate-source capacitance of NMOS transistor 53 to node N95. In FIG. 20 this caused the reference voltage Vref to increase temporarily from V40 to V40+ΔV2, but because the step-down control signal S30 has gone low, the reference voltage selector 70 simultaneously drives the reference-voltage select signal S90 low and reference-voltage select signal S91 high for an interval of time t4. During this interval, node N9A is low, node N9B is high, PMOS transistor 99 is turned off, and PMOS transistor 100 is turned on. Instead of rising to V40+ΔV2, accordingly, the potential at node N95 first falls from V40 to V40−β, then rises back to V40. Because of a feedback response delay, the internal power supply voltage VDD rises briefly, but the rise (ΔV8) is far smaller than rise of ΔV2 in FIG. 20.

The temporary increase in the reference voltage applied to node N95 from the normal level of V40 to V40+β cancels out the voltage drop that would occur at node N95 because of the gate-source capacitive coupling through NMOS transistor 93 immediately after the load circuit 2 enters the active state. The temporary decrease in the reference voltage applied to node N95 from V40 to V40−β cancels out the voltage rise that would occur at node N95 because of the gate-source capacitive coupling through NMOS transistor 93 immediately after the load circuit 2 enters the standby state. The load circuit 2 accordingly does not suffer temporary degradation of its response speed, timing margin, or input voltage margin to a degree that might lead to malfunction.

In the third, fourth, and fifth embodiments, the gates of NMOS transistors 23, 53, and 93 receive the reference voltage directly, but the reference voltage may be received through a resistor connected between the gate of the transistor and the reference voltage generator. In addition to or instead of this resistor, a resistor may be connected between the transistor gate and ground (VSS). Similar resistors may be inserted between the drain of PMOS transistors 47, 57, and 97 and the gates of NMOS transistors 24, 54, and 94, and/or between the gates of these NMOS transistors and ground (VSS). The resistors may be PMOS or NMOS transistors sized to provide a specified on-resistance.

The capacitor 28 in the third embodiment may be a PMOS or NMOS transistor with interconnected source-and drain electrodes.

In the fourth embodiment either PMOS transistor 58 or NMOS transistor 59 may be eliminated, and the pulse generator 60 may output only a single pulse signal to the remaining one of these two transistors.

Nodes N97, N98, and N99 are electrically connected to node N95 in the fifth embodiment by PMOS transistor switches, but NMOS transistor switches may be used, or a PMOS transistor and an NMOS transistor connected in parallel may be used for each switch.

The number of different reference voltages used in the fifth embodiment may be increased from three to four or more.

Those skilled in the art will recognize that further variations are possible within the scope of the invention, which is defined in the appended claims.

What is claimed is:

1. A step-down power supply for lowering an external power supply voltage with respect to a ground voltage to generate an internal power supply voltage equal to a referenced voltage and providing the internal power supply voltage to a load, then step-down power supply receiving a load activation signal indicating activation of the load, the step-down power supply comprising:

an internal power supply node through which the internal power supply voltage is provided to the load;

a control mode a differential amplifier having an output terminal connected to the control node, for comparing the internal power supply voltage with the reference voltage and adjusting a voltage of the control node with the internal power supply voltage differs from the reference voltage;

a driving having an input terminal receiving the external power supply voltage, a control terminal connected to the control node, and an output terminal connected to the internal power supply node, for supplying power to the internal power supply node at a voltage lower than the external power supply voltage by an amount responsive to the voltage of the control node;

a pull-down circuit for supplying the ground voltage to the control node for a first predetermined time in response to the load activation signal; and a pull-up circuit for supplying the external power supply voltage to the control node for a second predetermined time following the first predetermined time wherein the pull-up circuit comprises:

a pulse signal generator receiving the load activation signal and generating a pulse signal when the load activation signal is asserted;

a logic gate having an output terminal, an input terminal receiving the load activation signal, and another input terminal receiving the pulse signal output by the pulse signal generator; and a transistor having a current-conducting terminal receiving the external power supply voltage, another current-conducting terminal connected to the control node, and a control terminal connected to the output terminal of the logic gate.

2. The step-down power supply of claim 1, wherein the logic gate is a NAND gate and the transistor is a p-channel metal-oxide-semiconductor (PMOS) transistor.

3. A step-down power supply for lowering an external power supply voltage with respect to a ground voltage to generate an internal power supply voltage equal to a reference voltage and providing the internal power supply voltage to a load, the step-down power supply receiving a load activation signal indicating activation of the load, the step-down power supply comprising:

internal power supply node through which the internal power supply voltage is provided to the load;

a control node;

a differential amplifier having an output terminal connected to the control node, for comparing the internal power supply voltage with the reference voltage and adjusting a voltage of the control node when the internal power supply voltage differs from the reference voltage;

a driver having an input terminal receiving the external power supply voltage, a control terminal connected to the control node, and an output terminal connected to the internal power supply node, for supplying power to the internal power supply node at a voltage lower than the external power supply voltage by an amount responsive to the voltage of the control node;

a pull-down circuit for supplying the around voltage to the control node for a first predetermined time in response to the load activation signal; and a pull-up circuit for supplying the external power supply voltage to the control node for a second predetermined time following the first predetermined time;

wherein the pull-up circuit comprises:

an inverting delay line receiving the load activation signal and generating a delayed inverted signal;

a logic gate having an output terminal, an input terminal receiving the load activation signal, and another input terminal receiving the delayed inverted signal; and a transistor having a current-conducting terminal receiving the external power supply voltage, another current-conducting terminal connected to the control node, and a control terminal connected to the output terminal of the logic gate.

* * * * *